US006573216B1

(12) United States Patent
Washburn et al.

(10) Patent No.: US 6,573,216 B1
(45) Date of Patent: Jun. 3, 2003

(54) LASER IMAGEABLE CARBONLESS FORM

(75) Inventors: David E. Washburn, Kettering, OH (US); Dale Lakes, Dayton, OH (US); Joseph L. Klenke, Kettering, OH (US); Rajendra Mehta, Centerville, OH (US)

(73) Assignee: The Standard Register Company, Dayton, OH (US)

( * ) Notice: Subject to any disclaimer, the term of this patent is extended or adjusted under 35 U.S.C. 154(b) by 84 days.

(21) Appl. No.: 09/726,827

(22) Filed: Nov. 30, 2000

(51) Int. Cl.[7] ..... B41M 5/00

(52) U.S. Cl. ..... 503/201; 503/215; 503/226; 503/206

(58) Field of Search ..... 503/206, 200, 503/226, 215, 201

(56) References Cited

U.S. PATENT DOCUMENTS

| | | | | |
|---|---|---|---|---|
| 2,209,951 A | | 8/1940 | Pritzker | 282/12 |
| 2,362,101 A | | 11/1944 | Shields | |
| 2,503,680 A | | 4/1950 | Newman | 282/19 |
| 4,036,511 A | | 7/1977 | Maalouf | 282/27.5 |
| 4,996,184 A | * | 2/1991 | Bevan et al. | 503/226 |
| 5,154,668 A | | 10/1992 | Schubert | |
| 5,161,735 A | | 11/1992 | Bendel | 229/303 |
| 5,197,922 A | | 3/1993 | Schubert | 462/2 |
| 5,224,897 A | | 7/1993 | Linden et al. | 462/24 |
| 5,238,178 A | | 8/1993 | Hutchinson et al. | 229/92.1 |
| 5,248,279 A | | 9/1993 | Linden et al. | 462/8 |
| 5,253,798 A | | 10/1993 | Lombardo | 229/92.1 |
| 5,294,041 A | | 3/1994 | Whiteside | |
| 5,376,048 A | | 12/1994 | Whiteside | |
| 5,392,265 A | | 2/1995 | Linden et al. | 462/24 |
| 5,395,288 A | | 3/1995 | Linden et al. | 462/18 |
| 5,435,600 A | * | 7/1995 | Griffiths et al. | 283/81 |
| 5,776,571 A | | 7/1998 | Michlin et al. | 428/40.1 |
| 5,913,725 A | | 6/1999 | Goldring | 462/22 |
| 5,941,451 A | | 8/1999 | Dexter | 229/92.1 |
| 6,123,253 A | * | 9/2000 | Mehta et al. | 229/92.1 |
| 6,158,651 A | | 12/2000 | Mehta et al. | |
| 6,322,106 B1 | | 11/2001 | Mehta et al. | |

FOREIGN PATENT DOCUMENTS

| | | |
|---|---|---|
| BE | 1010066 A3 | 12/1997 |
| BE | 1010144 A6 | 1/1998 |

OTHER PUBLICATIONS

Joseph L Klenke, Dale Lakes; Laserable Fold Over Carbonless Form; Patent Application; 19 Pages.

* cited by examiner

*Primary Examiner*—Bruce H. Hess
(74) *Attorney, Agent, or Firm*—Killworth, Gottman, Hagan & Schaeff LLP

(57) ABSTRACT

A single ply carbonless form is provided where a sheet is divided into a first portion and a second portion. A coating of CF is applied to the first portion and a coating of CB is applied to the second portion, both on the same side of the sheet. A quantity of temporary tacking agent is applied to the back face of the sheet such that, upon folding the sheet in a manner where the CF and CB portions are not in contact with each other, the first portion is releasably held against the second portion. The form may then be sheet fed into a printing device, preferably using the folded edge as the leading edge. Subsequent to printing, the form may then be re-folded such that the CF and CB coating suitably line up for receiving impact impressions.

41 Claims, 10 Drawing Sheets

LASER IMAGEABLE CARBONLESS FORM

BACKGROUND OF THE INVENTION

The present invention relates in general to a carbonless form and more particularly to a laser imagable carbonless fold-over single sheet form.

Carbonless copy forms generally consist of two or more superposed sheets that have been treated such that an impact impression on the top sheet causes a copy of the impression to appear on the face of the remaining sheets. One known method for creating carbonless copies involves coating the back surface of a top sheet with a microencapsulated dye. This is sometimes referred to as a coated back (CB) coating. A bottom sheet has a front surface coated with a substance designed to react with the dye to reveal or alter the color of the dye. This is sometimes referred to as the coated front (CF) coating. The top sheet is then superposed on the bottom sheet. When the CF coating and the CB coating are in contact, and an impact impression is applied to the form, the microcapsules in the CB coating of the top sheet rupture releasing the dye. A copy from the impact impression is formed on the CF coated surface of the bottom sheet due to the reaction between the ruptured dye and the dye-revealing substance on the bottom sheet. This impact may be the result of writing on the form with pen or pencil, or the result of printing on the form with an impact printer, such as a dot matrix printer.

It has been desired that carbonless copy forms of this type be individually printed with a printer after the form is manufactured, such that the printing will only occur on one of the sheets making up the form. Unfortunately, it is often difficult to print carbonless copy forms using variable imaging devices such as ink jet and laser printers. The multiple layers that comprise the form may not pass smoothly through the printer. Rather the form may become pleated, or wrinkled, perhaps jamming the printer. Additionally, the top ply can skew, creating a misfeed and a printer jam. Further, depending upon the configuration of the CF and CB layers, and the desired printing requirements, passing the form through a printer may inadvertently rupture some of the microencapsulated dye, revealing ink in unintended positions.

SUMMARY OF THE INVENTION

The present invention overcomes the disadvantages of previously known carbonless forms. In the present invention, a single sheet is divided into a first portion and a second portion along a fold line. A reactive, dye revealing substance, or CF coating, is applied to the front face of the sheet within the first portion while a microencapsulated dye, or CB coating, is applied to the front face of the sheet within the second portion. Both the CB and CF coatings are applied to the same side of the sheet. A temporary tacking agent is applied to the back face of the sheet, such that when the sheet is folded backward along the fold line, the temporary tacking agent releasably holds the first portion against the second portion. The form may then be fed into a printing device, preferably using the folded edge as the leading edge. Subsequent to printing, the form is re-folded such that the CF and CB coating suitably line up for receiving impact impressions.

In accordance with one embodiment of the present invention, a form is constructed from a single sheet having a sheet face, a sheet back, and a fold line dividing the sheet into a first portion and a second portion. A first carbonless coating is applied to the sheet face within the first portion, and a second carbonless coating applied to the sheet face, within the second portion. A temporary tacking agent, preferably a repositionable adhesive, is applied to the sheet back such that, upon folding the sheet backwards along the fold line, the first portion is releasably held against the second portion by the temporary tacking agent. Preferably, the first carbonless coating comprises a CF coating while the second carbonless coating comprises a CB coating. Further, the fold line may be placed in any desired position. For example, where an application requires that both the first and second portions of the form be simultaneously printed on, the fold may be placed such that the second portion longitudinal dimension exceeds the first portion longitudinal dimension in size. The form is folded and positioned such that when placed in a suitable printer, the first portion may be printed upon at the same time that the exposed section of the second portion is printed upon. Additionally, the form may optionally contain one or more lines of weakening to divide the form into a plurality of panels. For example, the first portion may comprise a plurality of spaced lines of perforation, dividing the first portion into multiple panels. A temporary tacking agent may further be applied to the sheet back adjacent to each of the lines of weakening.

The first and second portions may further comprise a plurality of bores positioned adjacent to the fold line such that folding the first portion on the second portion, the plurality of bores on the first and second portions align. The bores enable a user to attach the form to other devices. Further, the second portion may contain one or more bores extending therethrough. Under this arrangement, the first portion contains indicia positioned such that, upon folding the sheet along the fold line wherein the second portion overlies the first portion, the indicia may be viewed through the bores in the second portion.

In accordance with another embodiment of the present invention, a form comprises a rectangular sheet having a sheet front surface, a sheet back surface, and a transverse fold line dividing the sheet into a first portion and a second portion. A coating of microencapsulated dye is applied to the sheet front surface within the second portion, and a coating of a dye reactive substance is applied to the sheet front surface within the first portion. A quantity of temporary tacking agent is applied to the sheet back surface and arranged such that when the sheet is folded along the transverse fold line and the sheet back surface rests against itself, the first portion back surface is releasably held to the second portion back surface by the quantity of temporary tacking agent. Preferably, the temporary tacking agent is a repositionable adhesive.

Optionally, the first portion may be divided into a plurality of panels, each of the plurality of panels being defined by lines of weakening in the first portion. The temporary tacking agent is applied in a strip along each of the plurality of panels, and preferably, the temporary tacking agent is applied in a strip adjacent to each of the lines of weakness in the first portion.

The first and second portions may further comprise a plurality of bores positioned adjacent to the transverse fold line such that folding the first portion on the second portion, the plurality of bores on the first and second portions align. The bores enable a user to attach the form to other devices. Further, the second portion may contain one or more revealing bores extending therethrough. Under this arrangement, the first portion contains indicia positioned such that, upon folding the sheet along the fold line wherein the second portion overlies the first portion, the indicia may be viewed through the revealing bores in the second portion.

In yet another embodiment of the present invention, a business form comprises a rectangular sheet having a sheet face, a sheet back, and a transverse fold line dividing the sheet into a first portion and a second portion. The first portion has a dimension in a direction normal to the transverse fold line which is less than the dimension of the second portion in a direction normal to the first transverse fold line. A pattern printed indicia is applied both to the sheet face within the first portion, and the sheet back within the second portion. A first carbonless coating applied to the sheet face within the first portion, and a second carbonless coating is applied to the sheet face within the second portion. A quantity of temporary tacking agent, preferably a repositionable adhesive, is applied to the sheet back such that folding the sheet about the transverse fold line, the first portion is releasably held against the second portion. Preferably, the first carbonless coating comprises a carbonless CF coating, and the second carbonless coating comprises a carbonless CB coating.

The sheet may contain one or more lines of weakening dividing the sheet into a plurality of panels. Under this arrangement, the temporary tacking agent may be applied adjacent to each of the lines of weakening.

The first and second portions may further comprise a plurality of bores positioned adjacent to the transverse fold line such that folding the first portion on the second portion, the plurality of bores on the first and second portions align. The bores enable a user to attach the form to other devices. Further, the second portion may contain one or more revealing bores extending therethrough. Under this arrangement, the first portion contains indicia positioned such that, upon folding the sheet along the fold line wherein the second portion overlies the first portion, the indicia may be viewed through the revealing bores in the second portion.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

Reference is made to FIGS. 1–12, which illustrate form construction according to the present invention. It will be appreciated that these are diagrammatic figures, and that the dimensions are not shown to scale.

Figure 1:
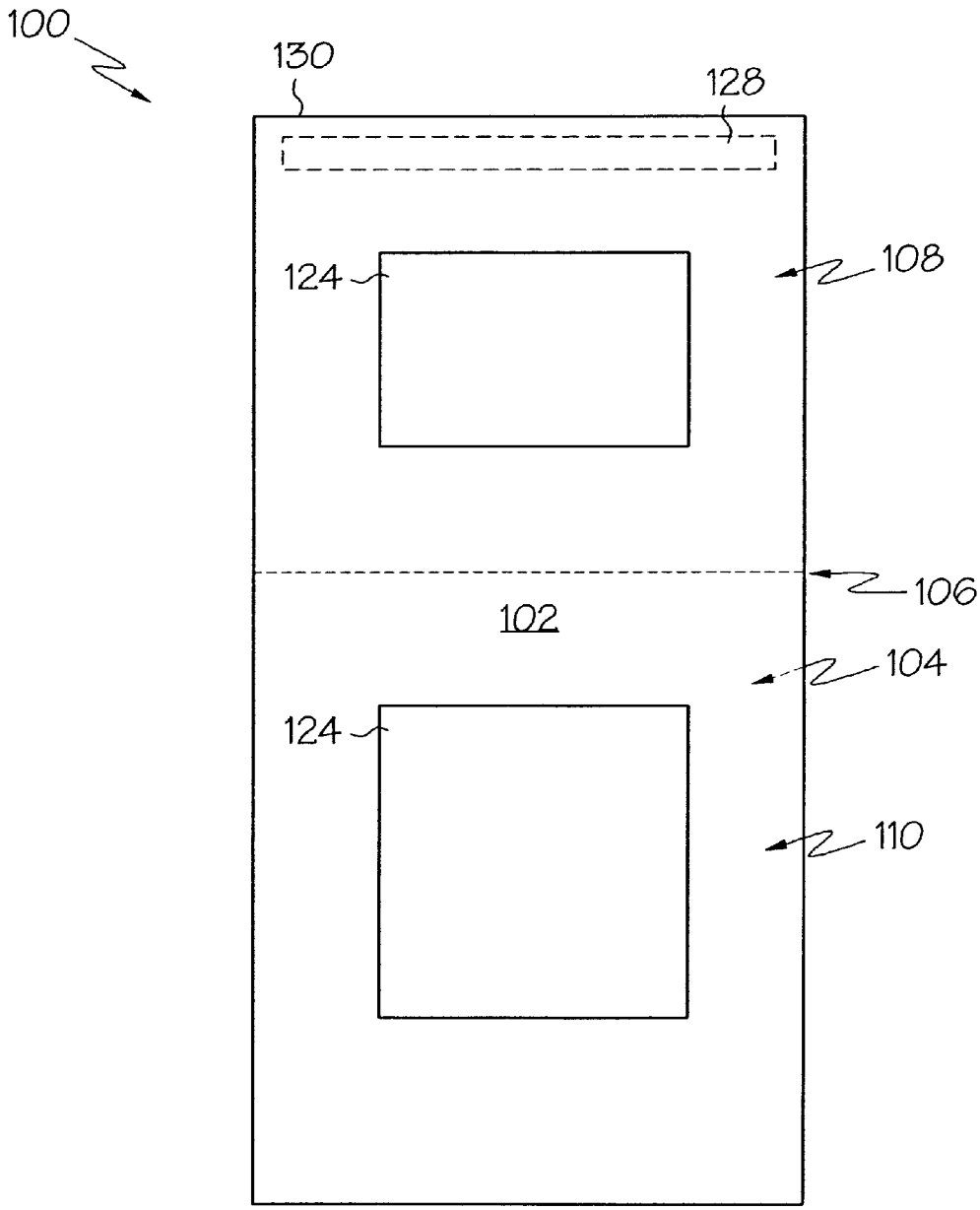
FIG. 1 is a plan view of the front side of a form according to the present invention in an unfolded position.

As shown in FIG. 1, the form includes a sheet 100 having a sheet face 102, a sheet back 104, and a fold line 106 that divides the sheet 100 into a first portion 108, and a second portion 110. As best illustrated in FIGS. 2–5, the sheet face 102, of the first portion 108 is coated with a first carbonless coating 112. The sheet face 102, of the second portion 110 is coated with a complimentary, second carbonless coating 114. The first carbonless coating 112 preferably comprises a coated front (CF) coating consisting of a dye reactive substance. The second carbonless coating 114 preferably comprises a coated back (CB) coating, consisting of a microencapsulated dye. The dye reactive substance of the first carbonless coating 112 should be selected such that it is capable of altering or revealing the dye of the second carbonless coating 114. Typically, the dye reactive substance of a CF coating reacts with the ruptured dye from a CB coating, either revealing or altering the color of the dye, causing a marking to appear on the surface having the CF coating. However, it should be appreciated by those skilled in the art that other carbonless coatings can be used without departing from the spirit of the present invention. Importantly, the first and second carbonless coatings 112, 114 are on the same side of sheet 100, and are separated by the fold line 106.

Figure 2:
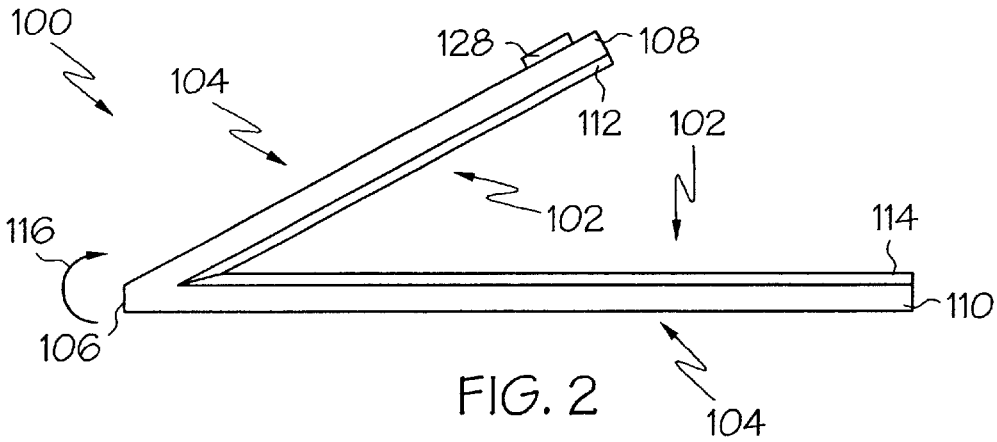
FIG. 2 is a diagrammatic view of the form of FIG. 1 as seen from the edge of the form, wherein the first portion is being folded against the second portion such that the carbonless coatings may cooperate to make impact impressions.
Figure 3:
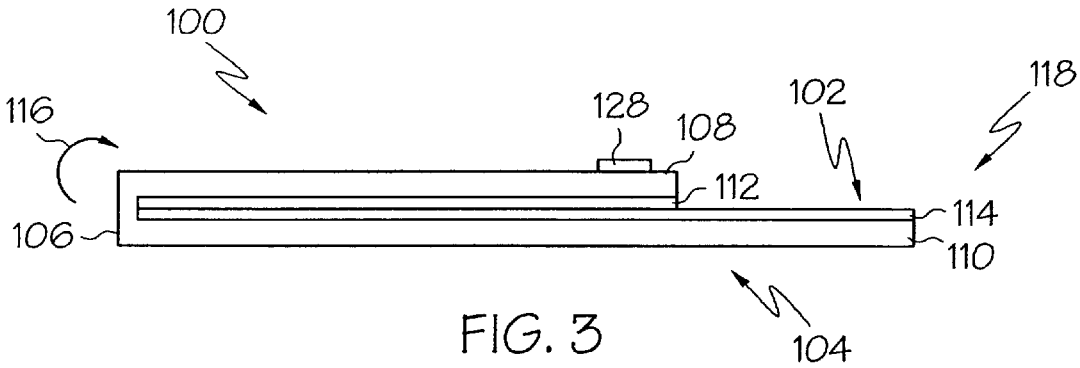
FIG. 3 is a diagrammatic view of the form of FIG. 1 as seen from the edge of the form in a first folded position, wherein the first portion is being folded against the second portion such that the carbonless coatings may cooperate to make impact impressions.

As shown in FIGS. 2 and 3, the sheet 100 may be folded in a forward direction about fold line 106 in the direction of the first directional arrow 116. As is best illustrated in FIG. 3, when this fold is completed, the sheet is in a first folded position 118, wherein the sheet face 102 is substantially flat against itself. Specifically, the sheet face 102, of the first portion 108 is substantially flat against the sheet face 102 of the second portion 110. In this position, at least a portion of the second carbonless coating 114 is in contact with at least a portion of the first carbonless coating 112. The sheet 100 is capable of generating copies of impact impressions while in the first folded position 118 when pressure is applied to the sheet 100 by writing on the sheet back 104 by a pencil, pen, or other object. Where the applied pressure overlies the first and second carbonless coatings 112, 114, an image is formed on the sheet face 102 of the first portion 108. The image formed is duplicative of the writing on the sheet back 104. Under this arrangement, where the second carbonless coating 114 consists of a CB coating of microencapsulated dye, and the first carbonless coating 112 consists of a dye reactive substance, the microcapsules containing dye in the second carbonless coating 114 will rupture where pressure is applied to the sheet 100 by the writing. If the ruptured dye contacts the first carbonless coating 112, the dye reacts with the first carbonless coating 112, and records a copy on the sheet face 102 within the first portion 108, of the image written on the sheet back 104.

Figure 4:
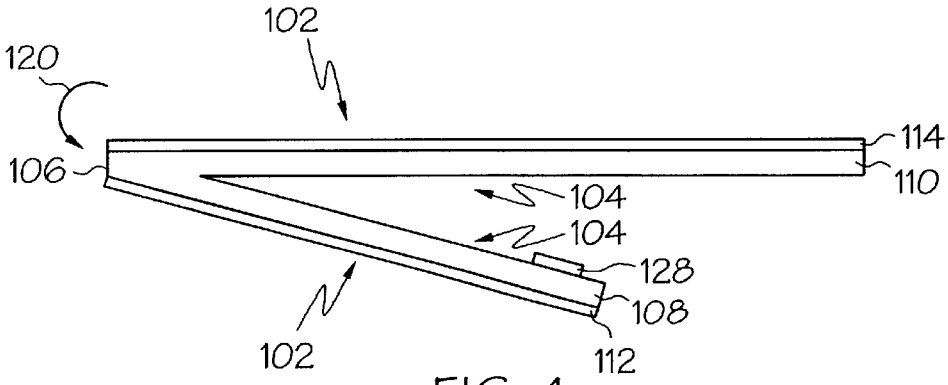
FIG. 4 is a diagrammatic view of the form of FIG. 1 as seen from the edge of the form, in which the form is being folded such that the carbonless coatings are not in contact.
Figure 5:
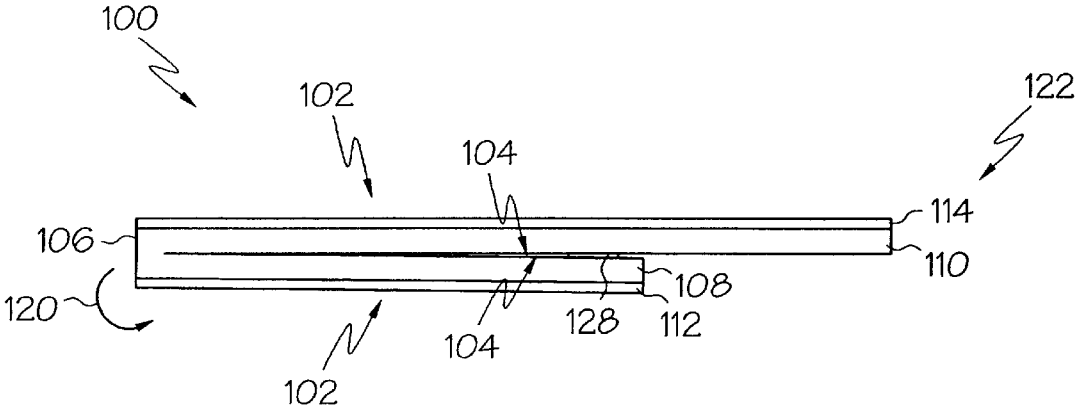
FIG. 5 is a diagrammatic view of the form of FIG. 1 as seen from the edge of the form in a second folded position, in which the form is folded such that the carbonless coatings are not in contact, and the first portion is temporarily tacked to the second portion using a temporary tacking agent.

Referring to FIGS. 4 and 5, the sheet 100 may be folded in a backward direction along fold line 106 in the direction of the second directional arrow 120. As best illustrated in FIG. 5, when this fold is completed, the sheet 100 is in a second folded position 122 wherein the sheet back 104 of the first portion 108 is substantially flat against the sheet back 104 of the second portion 110. When the sheet 100 is in the second folded position 122, the first carbonless coating 112 is not in contact with the second carbonless coating 114, and the sheet 100 is not ready to make carbonless impact impressions. As such, while the sheet 100 is in the second folded position 122, any or all of the exposed surfaces of the sheet may be printed, using imaging devices, such as laser printers, ink jet printers, or impact printers.

Figure 6:
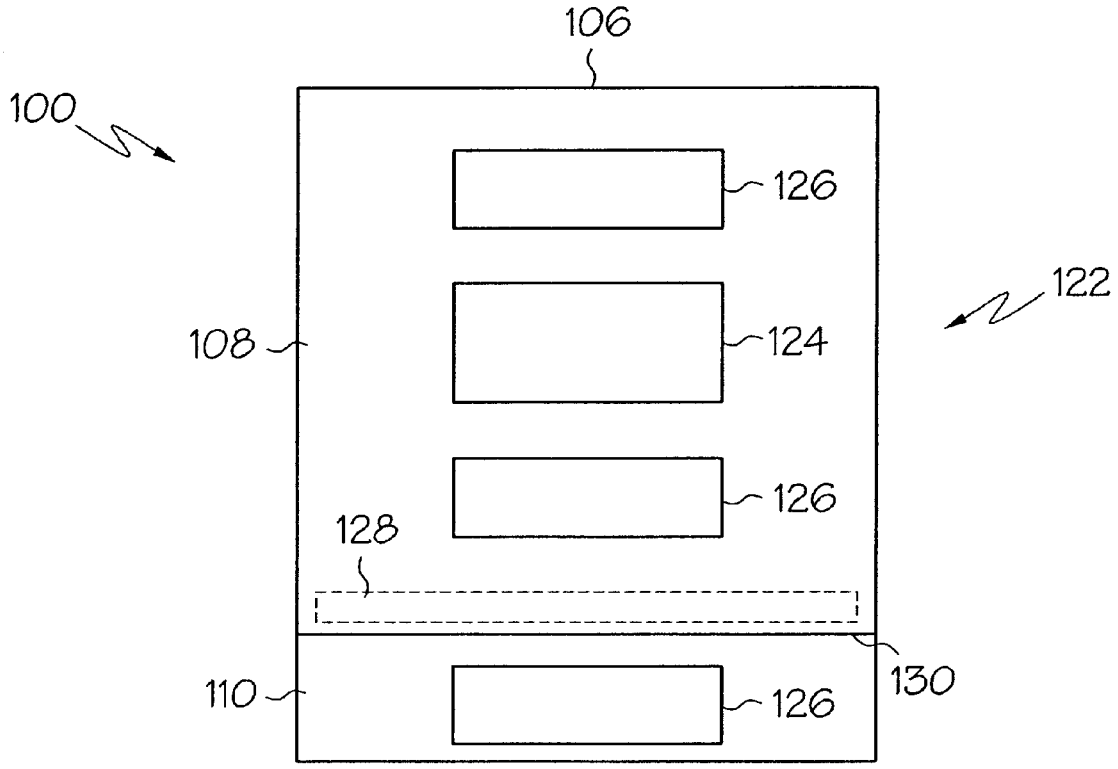
FIG. 6 is a plan view of the form according to FIG. 1 in the second folded position.

Referring now to FIGS. 1–6, typically, the form of the present invention will be manufactured by a business form manufacturer. The manufacturer coats the sheet 100 with the first and second carbonless coatings 112,114 and perfs the sheet creating the fold line 106, thus defining the first and second portions 108, 110. Further, the manufacturer may print non-varying information 124 on the sheet 100. While the non-varying information 124 is illustrated in FIG. 1 on the sheet face 102, it should be appreciated that the non-varying information 124 may also appear on the sheet back 104. Further, the order in which the form is printed, perfed and coated during manufacturing is not critical to practice the present invention. Referring to FIG. 6, in use, the user organization, such as for example a hospital, may then wish to add additional variable printed information 126 to the form. This variable printed information 126 may be unique to the user organization, but it is not intended to be copied on the form using the first and second carbonless coatings 112, 114. For this printing operation by the user organization, the form is folded into second folded position 122, illustrated by FIGS. 5 and 6, and printing may then be accomplished using any type of printer desired. Subsequently, the form is folded into the first folded position 118, illustrated in FIG. 3. The form is then ready for use in its intended manner, for example as a physician prescription form. Information which is written by hand on the sheet back 104 of either the first portion 108 or the second portion 110, is also written by means of the first and second carbonless coatings 112,114 respectively on the sheet face 102 of the first portion 108 as more fully described herein.

Referring to FIGS. 5 and 6, in printing the form in the second folded position 122, loose edges of sheet 100 could cause the printer mechanism to jam, mis-feeds may occur, and there might be difficulty using certain stacking output trays. One reason for this is that it is possible for the top portion of sheet 100, to skew as it is fed into a printer. The top portion could be either first portion 108, or second portion 110, depending upon user imaging requirements, printer characteristics, and the like. This problem has been solved in the present invention by temporarily holding down the loose edges of the sheet 100 by using a strip 128 of temporary tacking agent applied to the sheet back 104. The strip 128 of temporary tacking agent is illustrated in dashed lines in FIG. 1 to illustrate that the strip 128 of temporary tacking agent is actually applied to the sheet back 104. Further, the strip 128 of temporary tacking agent is illustrated in FIG. 6 in dashed lines to indicate that the strip 128 of temporary tacking agent is actually between the first and second portions 108 and 110.

As is best illustrated in FIG. 6, while the sheet 100 is in the second folded position 122, the strip 128 of temporary tacking agent, temporarily holds the first portion 108 against the second portion 110 adjacent to the first transverse edge 130. While the strip 128 of temporary tacking agent is illustrated in FIGS. 1–6 as a strip adjacent to the first transverse edge 130, it should be appreciated that the positioning of the strip 128 of temporary tacking agent can vary depending upon factors such as user imaging requirements, feed orientation of the sheet 100 into the printer, and other considerations. The strip 128 of temporary tacking agent may be applied to the sheet back 104 of either the first portion 108, or the second portion 110. Further, the strip 128 of temporary tacking agent may be applied as a continuous strip or strips, segments, spots, or any pattern selected to meet the needs of the particular application. The strip 128 of temporary tacking agent should be composed such that, when the sheet 100 is in the second folded position 122, the strip 128 of temporary tacking agent softly holds the first and second portions 108 and 110 together, while allowing some slight movement between the folded over first and second portions 108, 110. If the first and second portions 108,110 are held too tightly together, it is possible for puckering of the sheet 100 to occur, and creases may form along the sheet 100 while the sheet 100 is passing between the rolls inside a printer. The strip 128 of temporary tacking agent can be any of a number of types of agents including for example, a repositionable adhesive, wet fugitive glue or lift dry adhesive. The strip 128 of temporary tacking agent may also provide a means of securing the sheet 100, or a portion of the sheet 100, to a work surface while the sheet 100 is in either an unfolded position, or while the sheet 100 is in the first folded position 118 as more fully described herein.

Figure 7:
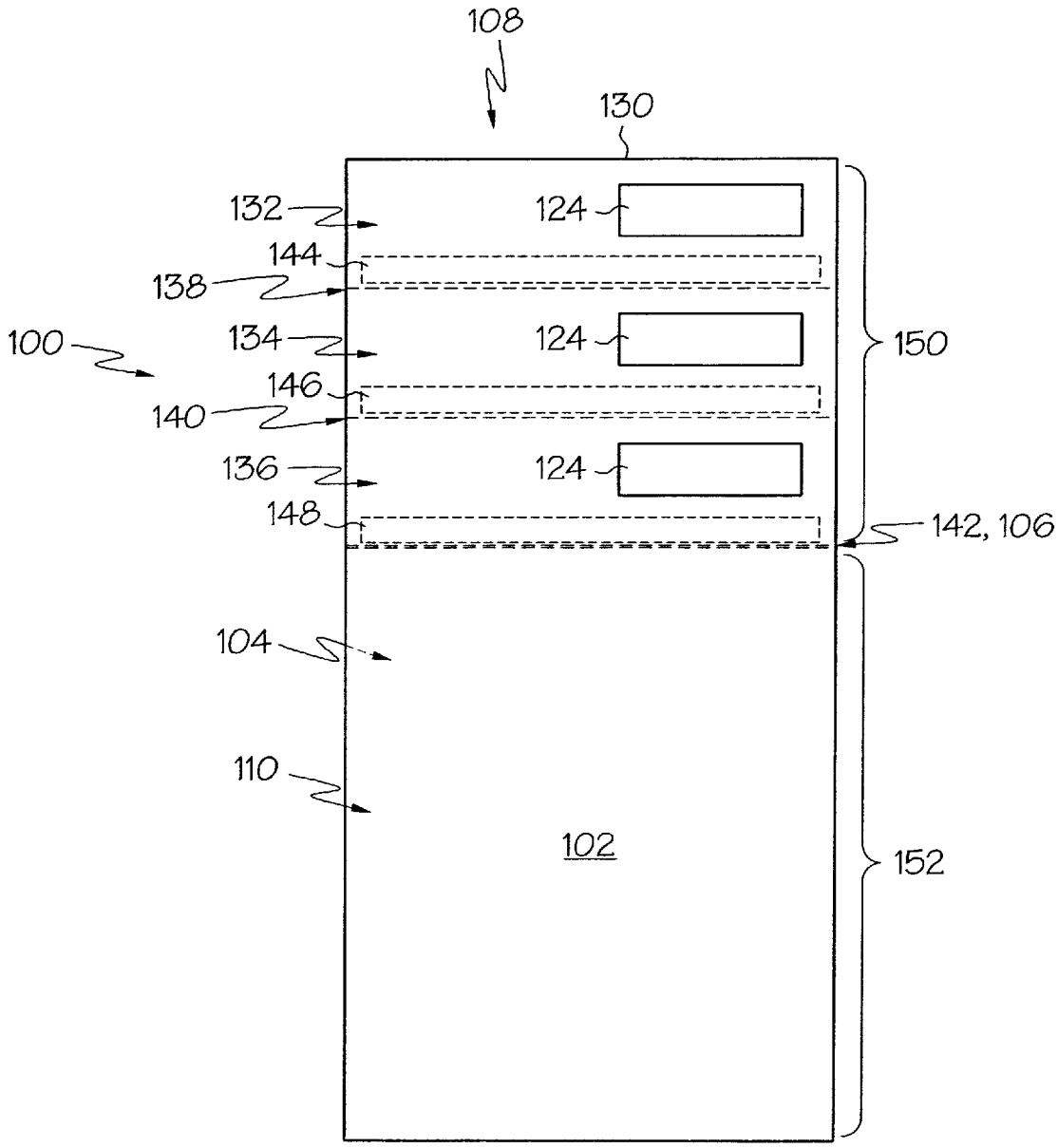
FIG. 7 is a plan view of the front side of another embodiment of the form of the present invention, illustrating the form in an unfolded position, and the first portion divided into multiple, separable panel sections by lines of weakness.

FIGS. 7–10 show another embodiment of the present invention, specifically designed for use as a physician's prescription form. In FIGS. 7–10, reference numerals corresponding to those used in describing the embodiment of FIGS. 1–6 have been used to delineate corresponding elements. As shown in FIG. 7, the first portion 108 is further divided into first, second and third panels 132, 134, and 136 respectively, by scoring first and second transverse lines of weakness 138, 140 respectively, along the sheet 100. Optionally, the fold line 106 may be comprised of a third transverse line of weakness 142 to facilitate separation of the first and second portions 108, 110 by the user. It should be appreciated by those skilled in the art, that the sheet 100, including both the first portion 108, and second portion 110, can be divided into any number of panels or other geometries, depending upon user requirements. Further, while the first, second and third transverse lines of weakness 138,140,142 are used in this specific example, they are not required to practice the present invention, and alternatively, any number of additional lines of weakness may be used depending upon user requirements.

Figure 8:
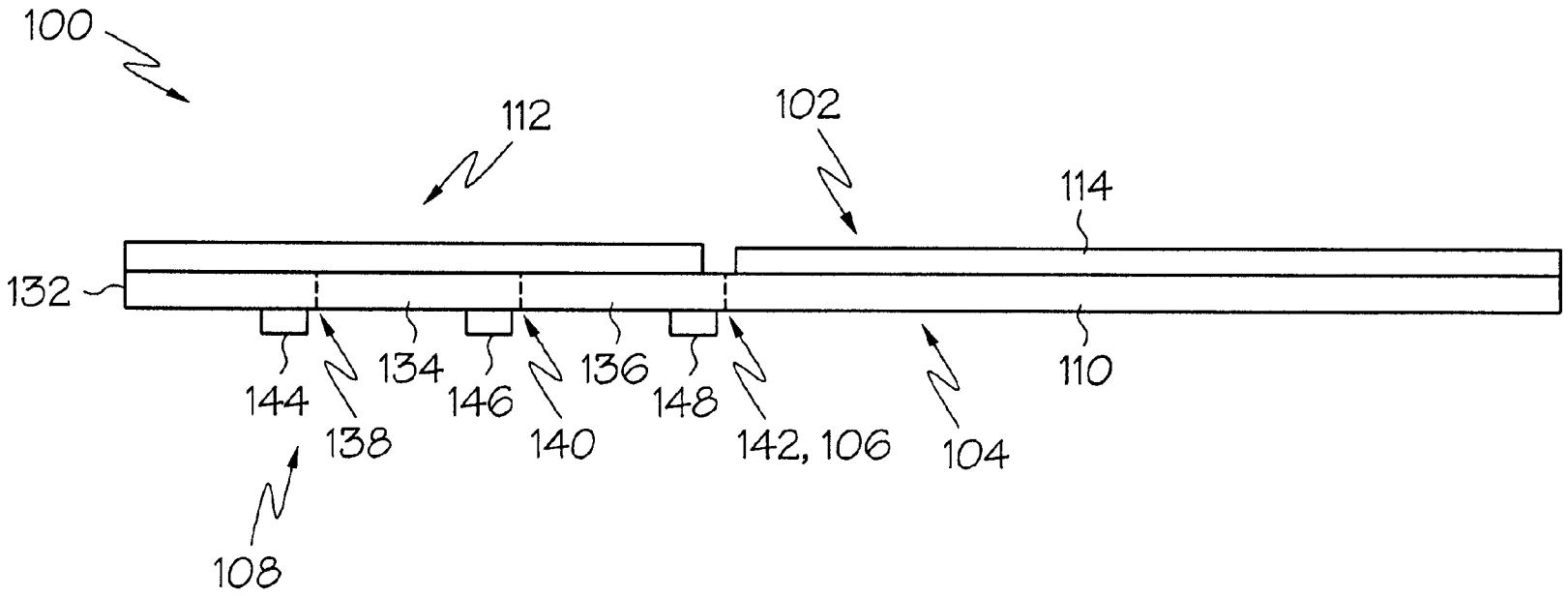
FIG. 8 is a diagrammatic view of the form of FIG. 7 as seen from the edge of the form, illustrating the position of carbonless coatings and temporary tacking agent.

As seen in FIG. 8, the first carbonless coating 112 is applied to the sheet face 102, of the first, second and third panels 132, 134, and 136, and the second carbonless coating 114 is applied to the sheet face 102 of the second portion 110. The first and second carbonless coatings 112, 114 are on the same side of sheet 100.

Figure 9:
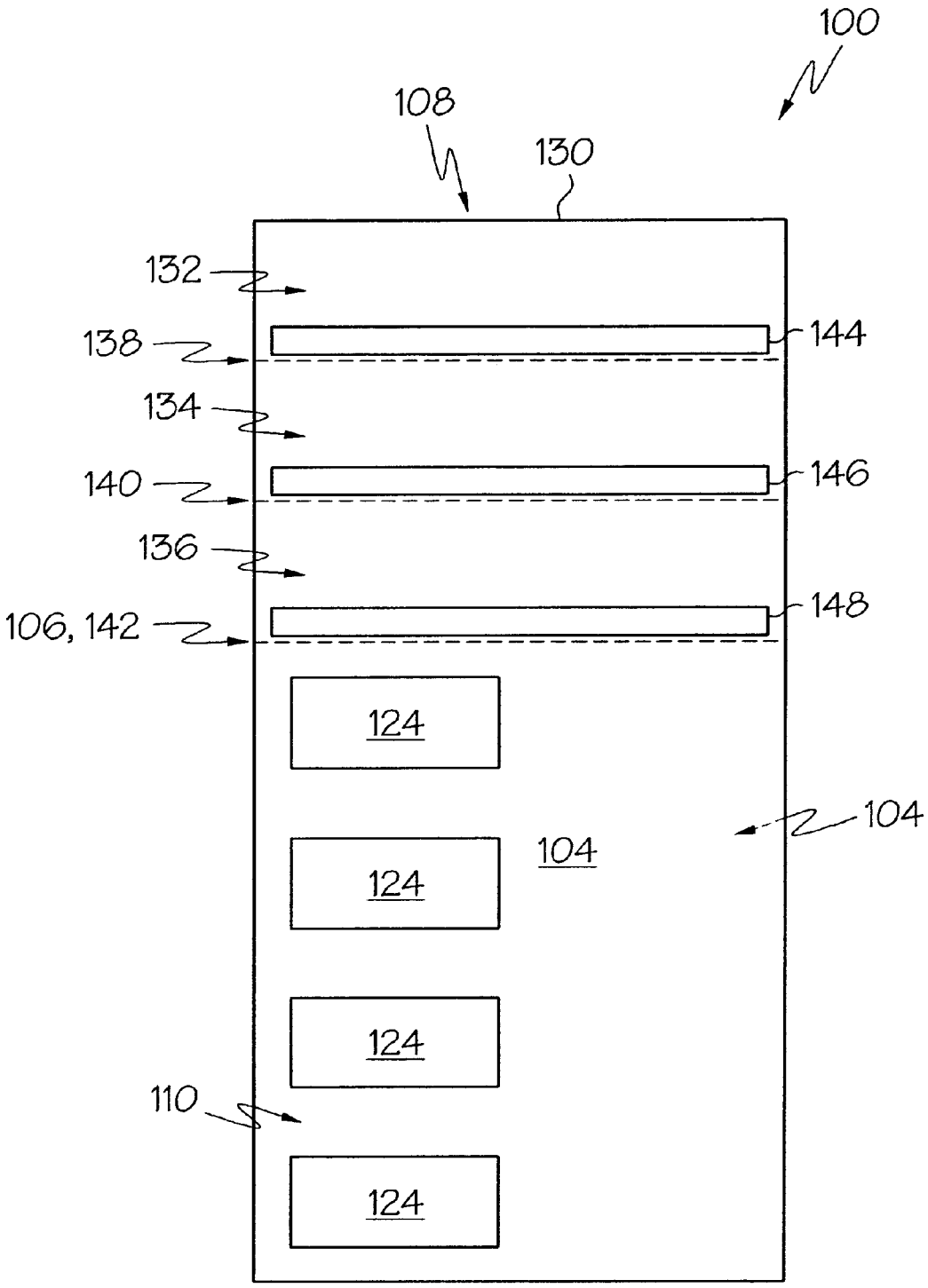
FIG. 9 is a plan view of the back side of the form of FIG. 7, illustrating the position of the strips of temporary tacking agent.
Figure 10:
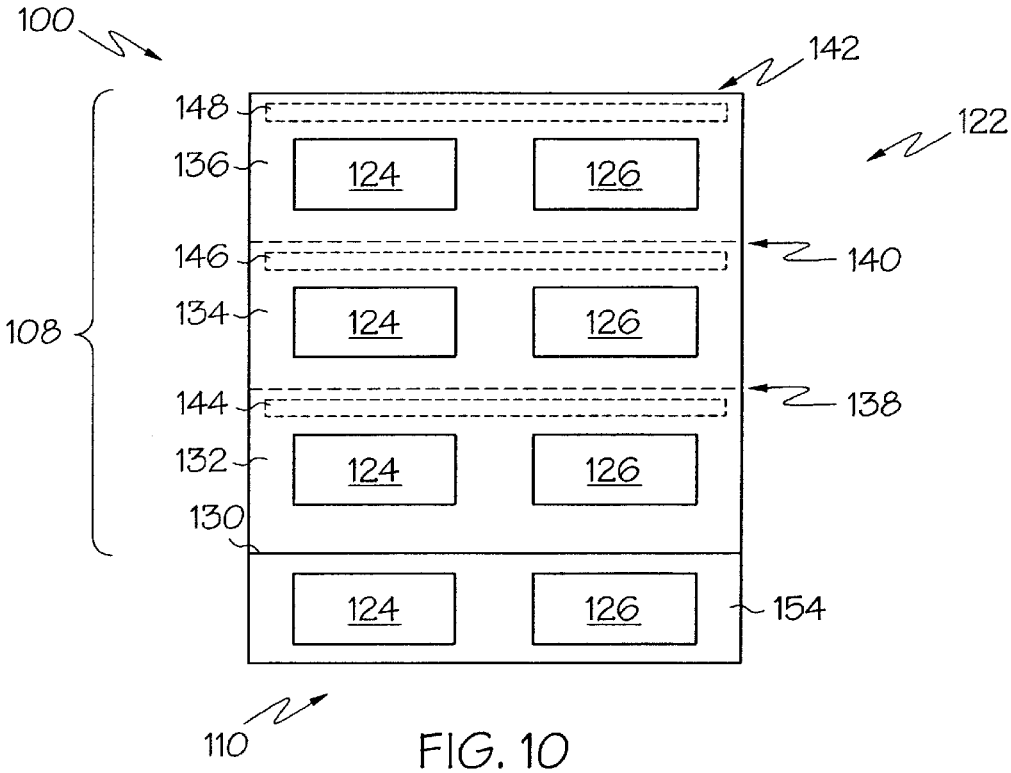
FIG. 10 is a plan view of the form according to FIG. 7 in the second folded position.

As seen in FIGS. 7, 9 and 10, while not required to practice the present invention, the sheet 100 may be pre-printed with non-varying information 124 to accommodate specific user applications. It will be understood that any type of printing, on either side, and in any portion of the sheet 100 may be realized within the spirit of the present invention as more fully described above. For example, the sheet face 102 of the first portion 108, as well as the sheet back 104 of the second portion 110, may be preprinted with non-varying information 124 including formatting to provide users a place to record data, such as the date, the time, a space for hand written notes, a space for a doctor's signature, or nurse's initials. The same non-varying information 124 may be pre-printed in each of the first, second and third panels 132, 134, and 136, in the first portion 102. Similar pre-printed material may appear on the second portion 110 on the sheet back 104.

As may be seen in FIGS. 7–9, the sheet back 104 has first, second and third transverse strips 144, 146, and 148 of a temporary tacking agent. The first, second and third transverse strips 144, 146 and 148 of temporary tacking agent are illustrated in FIG. 7 as dashed lines to indicate that the first, second, and third transverse strips 144, 146, and 148 are actually on the sheet back 104. Further, the first, second and third transverse strips 144, 146 and 148 of temporary tacking agent are illustrated in FIG. 10 as dashed lines to illustrate that the first, second, and third transverse strips 144, 146, 148 of temporary tacking agent are between the second portion 110 and corresponding first, second and third panels 132, 134,136. Referring to FIG. 10, when the sheet 100 is in the second folded position 122, the first, second and third panels 132, 134 and 136 are releasably held to the second portion 110 by first, second and third transverse strips 144,146, and 148 of temporary tacking agent respectively. As illustrated in FIG. 10, the first transverse strip 144 of temporary tacking agent spans the first panel 132 adjacent to the first transverse line of weakening 138. Similarly, the second transverse strip 146 of temporary tacking agent spans the second panel 134 adjacent to the second transverse line of weakening 140, and the third transverse strip 148 of temporary tacking agent spans the third panel 136 adjacent to the third transverse line of weakening 142. The exact positioning of the first, second and third transverse strips 144, 146, and 148 of temporary tacking agent will be determined by the desired printer feed orientation of the sheet 100, user variable imaging requirements, the particular printer intended to be used, and other like considerations. Further, the first, second, and third strips 144,146,148 of temporary tacking agent may be applied to either the first, second and third panels respectively, or the second portion 110 in any pattern required by the user. For example, the temporary tacking agent may be applied as a continuous span, or a discontinuous line of segments, or spots as described above.

Referring to FIG. 7, the third transverse line of weakening 142 is positioned along the sheet 100 such that the longitudinal length 150 of the first portion 108 is shorter than the longitudinal length 152 of the second portion 110. Referring to FIG. 10, the sheet 100 is folded about the third transverse line of weakening 142 into the second folded position 122. It should be appreciated that while the sheet 100 is in folded position 122, the first carbonless coating 112 (not shown in FIG. 10) is on top of the folded sheet 100, and the second carbonless coating 114 (also not shown in FIG. 10) is on the bottom of the sheet 100. In this arrangement, the first and second carbonless coatings 112,114 are not in contact. The first, second and third panels 132, 134,and 136 are releasably held to the second portion by the first, second and third transverse strips 144, 146 and 148 of temporary tacking agent respectively. The sheet 100 may be fed into a laser printer, preferably using the third transverse line of weakening 142 as the leading edge into the printer, such that variable printed information 126 is printed on the sheet face 102 on the first portion 108. Because the longitudinal length 150 of the first portion 108 is less than the longitudinal length 152 of the second portion 110, the exposed section 154 of the second portion 110 may also receive variable printed information 126. It should be appreciated that both the first portion 108, and the exposed section 154 of the second portion 110 can be printed on their respective faces in a single pass. Because the first and second carbonless coatings 112, 114 are not in contact with each other, printing on the first portion 108 will not be replicated on the second portion 110. Bar coded, and textual information, including patient name and address, may for instance be printed on the first portion 108, and on the exposed section 154 of the second portion 110. It should be appreciated by those skilled in the art that the longitudinal length 150 of the first portion 108 could also be equal to, or alternatively greater than, the longitudinal length 152 of the second portion 110.

Figure 11:
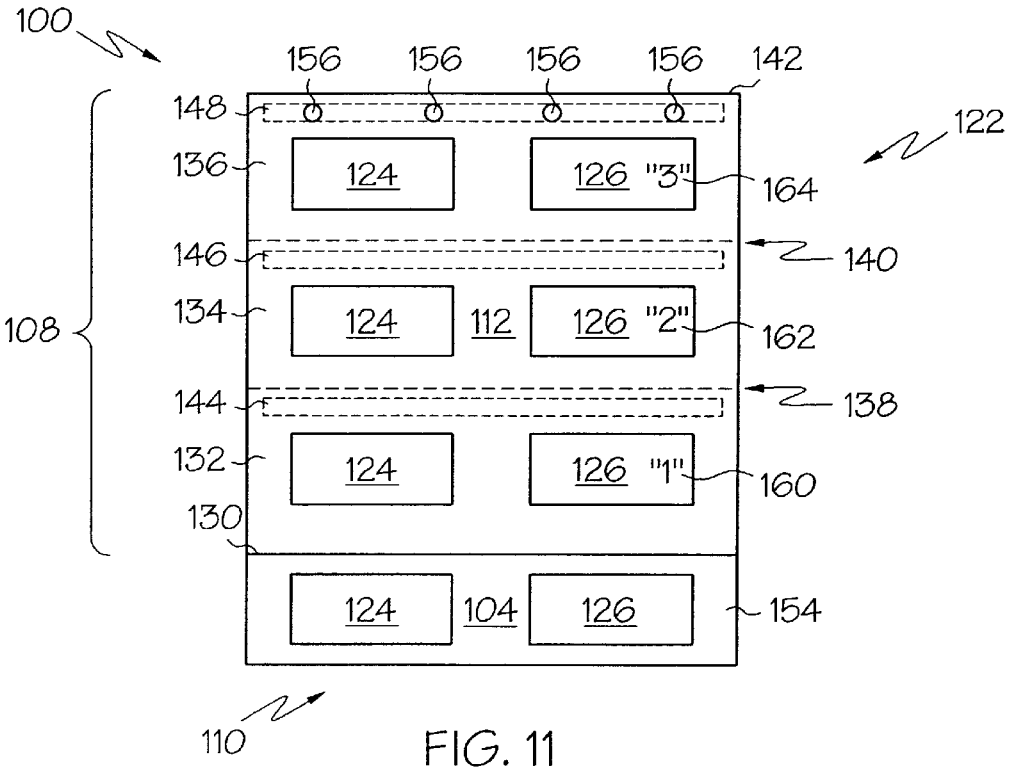
FIG. 11 is a plan view of another embodiment of the form of the present invention in a folded position.
Figure 12:
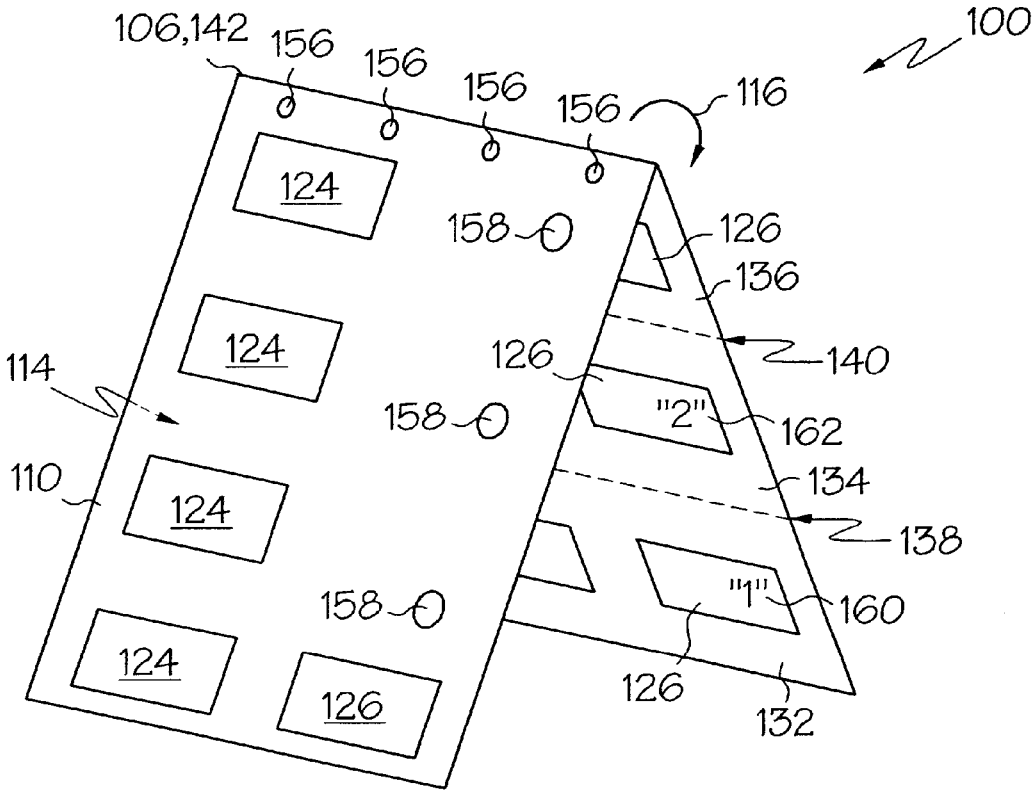
FIG. 12 is an illustration of the embodiment of FIG. 11, as it is being folded over into a folded position ready for use; and, FIG. 13 is an illustration of an embodiment of the present invention similar to FIG. 12, differing in the orientation of the form.

FIGS. 11 and 12 show another embodiment of the present invention which, except for the instances noted below, is identical in construction to that of the previous embodiments. Thus corresponding elements have been designated with the same reference numerals. FIG. 11 depicts the sheet 100 folded along the third transverse line of weakening 142 in the second folded position 122. The sheet 100 optionally provides symmetrically positioned bores 156 extending through the third panel 136 and the second portion 110 adjacent to the third transverse line of weakening 142.

In this embodiment, variable printed information 126 including patient information is printed on panel 132, on panel 134, and on panel 136. The information preferably pertains to the same patient, but could relate to several patients. Further, the exposed section 154 of the second portion 110 receives variable printed information 126.

Notably, because of the folding process, the first, second and third panels 132, 134 and 136 may receive variable printed information 126 directly on top of the first carbonless coating 112, while the second portion 110 receives variable printed information 126 on the sheet back 104. Further, it is understood that any portion of the sheet 100 can receive user variable printing. Likewise, while this example is being described with reference to patient or medical information by way of illustration, it is not intended to be a limitation. In fact, the printed information can include any information for any number of different applications desired by the user.

As shown in FIG. 11, the first, second and third panels 132, 134 and 136 are held to the second portion 110 by first, second, and third transverse strips 144,146,148 of temporary tacking agent as described above. It will be appreciated that the first, second, and third transverse strips 144,146,148 of temporary tacking agent are illustrated in dashed lines to indicate that the first, second, and third transverse strips 144, 146, 148 of temporary tacking agent are actually positioned between the first and second portions 108, 110.

FIG. 12 illustrates reverse folding the sheet 100 according to the directional arrow 116. When the fold is completed, the first, second and third panels 132,134 and 136 are folded over the second portion 110 such that the second portion 110 is positioned on top, and the form will be ready for use. In this manner, the second carbonless coating 114 of the second portion 110 is in contact with the first carbonless coating 112 of the first, second and third panels 132, 134 and 136 .

To use the invention, patient and prescription information is handwritten on the sheet 100 while in the position illustrated in FIG. 12. As described above, the second carbonless coating 114, for example a microencapsulated dye, on the second portion 110, is positioned to contact the first carbonless coating 112 on the first, second and third panels 132, 134 and 136. When an impact impression is made upon the sheet 100, the microcapsules rupture releasing the dye. The released dye reacts with the dye reactive substance in the first carbonless coating 112, thus creating a copy of the impact impression on the corresponding first, second or third panels 132, 134 and 136.

Referring to FIGS. 11 and 12, the individual filling out the sheet 100 writes information by hand into the second portion 110, in a region that is substantially aligned with the first panel 132. This creates an impact impression on the first portion 108 within the first panel 132. The first panel 132 can now be torn off, for example, by tearing the sheet 100 along the first transverse line of weakening 138. Once the first panel 132 has been removed from the remainder of the sheet 100, it may be used, for example, as a fax slip to send information to a pharmacy. Alternatively, the first panel 132 may be used for other processing purposes. Where the first strip 144 of temporary tacking agent remains with the first panel 132, the first panel 132 may be used in any application requiring temporary adhesion to a surface by the first transverse strip 144 of temporary tacking agent. Likewise, the same procedure can be repeated by writing on the second portion 110 in a region which aligns with, and which causes impact impressions on, the second panel 134. The second panel 134, including the second transverse strip 146 of temporary tacking agent, may optionally be removed by tearing the second panel 134 along the second line of weakening 140. Finally, the process is repeated for the third panel 136. The third transverse line of weakening 142 allows the third panel 136 to be removed from the remainder of the sheet 100. The second portion 110 may then be retained to provide g source for the original information.

Where the sheet 100 is to be used by tearing off the first, second and third panels 132, 134, 136, along respective lines of weakening 138, 140 and 142, additional, optional bores 158 can be provided on the second portion 110. The first portion 108 contains first, second and third indicia 160, 162, and 164, that align with respective bores 158 when the sheet 100 is folded along the third transverse line of weakening 142 such that the first and second carbonless coatings 12, 114 are in cooperation with one another. For example, as illustrated in FIGS. 11 and 12, indicia 160, the number "1" as illustrated, is printed on panel 132. Similarly, indicia 162, the number "2" as illustrated, is printed on second panel 134, and indicia 164, the number "3" as illustrated, is printed on the third panel 136. When the sheet 100 is folded such that the first and second carbonless coatings 112, 114 are in contact, the bores 158 provided along the second portion 110 circumscribe and reveal the indicia 160,162, and 164, the numbers "1"–"3" as illustrated, on their associated first, second, and third panels 132, 134, 136. A user fills in the sheet 100 along the second portion 110, associated with the first panel 132, and then tears off the first panel 132 by ripping the first portion 108 along the first transverse line of weakening 138. Indicia 160, the number "1", no longer appears through the associated bore 158 in the second portion 110, making it apparent that the first panel 132 is no longer attached to the sheet 100. This process is repeated until each of the first, second, and third panels have been removed from the sheet 100.

Figure 13:
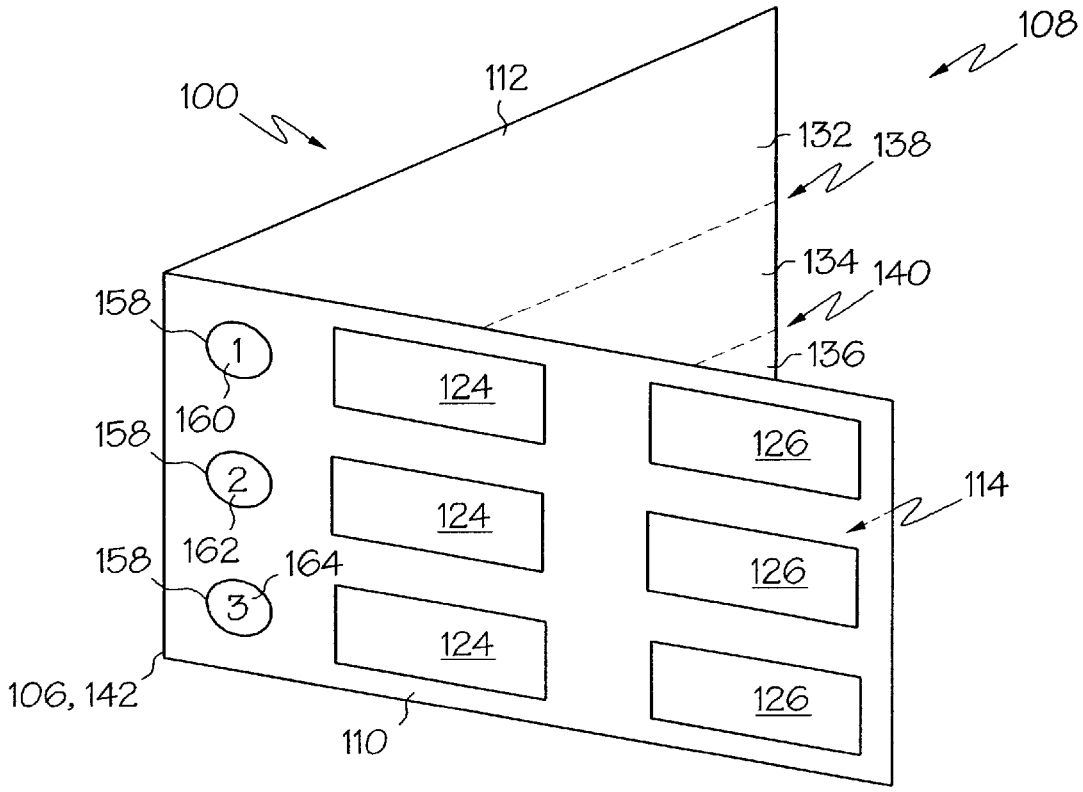

The embodiment illustrated in FIG. 13 is similar to the embodiment illustrated in FIG. 12, and as such, like references are indicated with like numerals. The sheet 100 as shown in FIG. 13 may be used in the manner similar to that described above. However, referring to FIG. 13, the fold line 106 spans the sheet 100 longitudinally in a book-like fashion. Likewise the line of weakening 142 spans the sheet 100 longitudinally, and overlies the fold line 106. Lines of weakening 138 and 140 extend across the first portion 108 dividing the first portion 108 into first, second and third panels 132, 134, and 136. Bores 158 in the second portion 110 reveal indicia 160, 162, and 164 (numerals 1, 2, and 3 as illustrated) in their associated first, second, and third panels 132, 134, 136. Otherwise, the sheet 100 functions as described above, including the cooperation of the first and second carbonless coatings 112, 114.

Having described the invention in detail and by reference to preferred embodiments thereof, it will be apparent that modifications and variations are possible without departing from the scope of the invention defined in the appended claims.

What is claimed is:

1. A form comprising:

a sheet having a sheet face, a sheet back, and a fold line dividing said sheet into a first portion and a second portion, said sheet selectively foldable about said fold line into a first folded position defined by folding said sheet face towards itself, and a second folded position defined by folding said sheet back towards itself;

a first carbonless coating applied to said sheet face within said first portion;

a second carbonless coating applied to said sheet face within said second portion;

a quantity of temporary tacking agent applied to said sheet back and arranged thereon such that when said sheet is folded into said second folded position, said first portion is releasably held to said second portion by said quantity of temporary tacking agent in a manner suitable for printing on said sheet using a printer and, indicia applied to said sheet while said sheet is in said second folded position.

2. A form according to claim 1, wherein said first carbonless coating comprises a carbonless CF coating.

3. A form according to claim 1, wherein said second carbonless coating comprises a carbonless CB coating.

4. A form according to claim 1, wherein said first portion further has a first portion longitudinal length, and said second portion further has a second portion longitudinal length, and wherein said second portion longitudinal length exceeds said first portion longitudinal length such that, when said sheet is in said second folded position, said indicia may be printed on both said first and portions in a single pass.

5. A form according to claim 1, wherein said quantity of temporary tacking agent comprises a repositionable adhesive.

6. A form according to claim 1, wherein said sheet contains one or more lines of weakening.

7. A form according to claim 1, wherein said first portion contains one or more lines of weakening.

8. A form according to claim 7, wherein said quantity of temporary tacking agent is applied to said sheet back as a strip of temporary tacking agent generally adjacent to at least one of said one or more lines of weakening.

9. A form according to claim 1, wherein a line of weakening is scored along said fold line.

10. A form according to claim 1, wherein said first portion further comprises a first plurality of bores positioned adjacent to said fold line, and said second portion further comprises a second plurality of bores adjacent said fold line, such that folding said first portion on said second portion, said first and second plurality of bores on said first and second portions align.

11. A form according to claim 1, wherein said second portion contains one or more bores extending therethrough.

12. A form according to claim 11, wherein said first portion contains indicia positioned such that, upon folding said sheet along said fold line wherein said second portion overlies said first portion, said indicia may be viewed through said one or more bores.

13. A form according to claim 1, wherein said temporary tacking agent is arranged in a plurality of discontinuous segments.

14. A form according to claim 1, further comprising indicia applied to said sheet face.

15. A form according to claim 1, further comprising indicia applied to said sheet back.

16. A form according to claim 1, wherein said quantity of temporary tacking agent is positioned on said sheet back sufficient to prevent said first portion from skewing relative to said second portion when said sheet is in said second folded position and said sheet is fed through said printer.

17. A form according to claim 1, wherein said quantity of temporary tacking agent is applied to said sheet back in a sufficient quantity to softly hold said sheet back to itself when said sheet is in said second folded position and while said sheet is fed through said printer.

18. A form according to claim 1, wherein said quantity of temporary tacking agent is further arranged to be of suitable location within said sheet back to releasably secure said sheet to an object when said sheet is not in said second folded position.

19. A form comprising:

a rectangular sheet having a sheet front surface, a sheet back surface, and a transverse fold line dividing said sheet into a first portion and a second portion;

a coating of microencapsulated dye applied to said sheet front surface within said second portion;

a coating of a dye reactive substance applied to said sheet front surface within said first portion;

a quantity of temporary tacking agent applied to said sheet back surface, wherein said sheet is foldable in a first direction such that said coating of dye reactive substance is in cooperation with said coating of microencapsulated dye, and said sheet is foldable in a second direction such said first portion back surface is releasably held to said second portion on said sheet using a printer; and, indicia applied to said sheet while said sheet is folded in said second direction.

20. A form according claim 16, wherein said quantity of temporary tacking agent comprises a repositionable adhesive.

21. A form according to claim 19, wherein said first portion is divided into a plurality of panels, each of said plurality of panels being defined by lines of weakening in said first portion.

22. A form according to claim 21, wherein said temporary tacking agent is applied in a strip along at least one of said plurality of panels.

23. A form according to claim 21, wherein said temporary tacking agent is applied in a strip adjacent to one or more of said lines of weakness in said first portion.

24. A form according to claim 19, wherein said temporary tacking agent is applied to said sheet back within said first portion.

25. A form according to claim 19, wherein a line of weakening is scored along said transverse fold line.

26. A form according to claim 19, wherein said first portion further comprises a first plurality of bores positioned adjacent said transverse fold line, and said second portion further comprises a second plurality of bores adjacent said transverse fold line, such that superposing said first portion on said second portion, said first and second plurality of bores in said first and second portions align.

27. A form according to claim 19, wherein said second portion contains one or more bores extending therethrough.

28. A form according to claim 27, wherein said sheet front surface contains indicia on said first portion such that when said sheet is folded in said first direction, said indicia may be viewable through at least one of said bores.

29. A business form comprising:

a rectangular sheet having a sheet face, a sheet back, and a transverse fold line dividing said sheet into a first portion and a second portion; said first portion having a dimension in a direction normal to said transverse fold line which is less than the dimension of said second portion in a direction normal to said first transverse fold line;

a first carbonless coating applied to said sheet face within said first portion;

a second carbonless coating applied to said sheet face within said second portion;

a quantity of temporary tacking agent applied to said sheet back such that folding said sheet about said transverse fold line, said first portion is releasably held against said second portion; and, a pattern printed indicia applied to said sheet face within said first portion, and said sheet back within said second portion while said first portion is releasably held against said second portion by said quantity of temporary tacking agent.

30. A form according to claim 27, wherein said first carbonless coating comprises a carbonless CF coating.

31. A form according to claim 29, wherein said second carbonless coating comprises a carbonless CB coating.

32. A form-according to claim 29, wherein said quantity of temporary tacking agent comprises a repositionable adhesive.

33. A form according to claim 29, wherein said sheet contains one or more lines of weakening dividing said sheet into a plurality of panels.

34. A form according to claim 33, wherein said temporary tacking agent is applied adjacent to at least one of said one or more lines of weakening.

35. A form according to claim 29, wherein a line of weakening is scored along said fold line.

36. A form according to claim 29, wherein said first portion further comprises a first plurality of bores positioned adjacent to said fold line, and said second portion further comprises a second plurality of bores adjacent to said fold line, such that folding said sheet along said transverse fold line, said first and second plurality of bores in said first and second portions align.

37. A form according to claim 29, wherein said second portion contains one or more bores extending therethrough.

38. A form according to claim 37, wherein said first portion contains indicia oriented such that, folding said sheet along said transverse fold line, said indicia are viewable through at least one of said bores.

39. A form according to claim 29, wherein said temporary tacking agent comprises a plurality of discontinuous segments.

40. A business form comprising:

a generally rectangular sheet having a sheet face, a sheet back, and a transverse fold line dividing said sheet into a first portion and a second portion, said sheet selectively foldable about said fold line into a first folded position defined by folding said sheet face towards itself, and a second folded position defined by folding said sheet back towards itself;

said first portion having a dimension in a direction normal to said transverse fold line which is less than the dimension of said second portion in a direction normal to said first transverse fold line;

said first portion divided into a plurality of panels by a plurality of transverse lines of weakening;

a first carbonless coating applied to said sheet face within said first portion;

a second carbonless coating applied to said sheet face within said second portion; and, a strip of repositionable adhesive applied to said sheet back adjacent to at least one of said plurality of transverse lines of weakening and arranged thereon such that when said sheet is folded into said second folded position, said first portion is releasably held to said second portion by said strip of repositionable adhesive in a manner suitable for printing on said sheet using a printer;

first indicia printed onto said sheet while said sheet is in said second folded position;

a plurality of bores extending through said second portion; and second indicia applied to said first portion and oriented such that, folding said sheet along said transverse fold line, said second indicia are viewable through said plurality of bores.

41. A method of using a fold-over carbonless form comprising:

obtaining a form comprising:

a sheet having a sheet face, a sheet back, and a fold line dividing said sheet into a first panel and a second panel, said sheet selectively foldable about said fold line into a first folded position defined by folding said sheet face towards itself, and a second folded position defined by folding said sheet back towards itself;

a first carbonless coating applied to said sheet face within at least a portion of said first panel;

a second carbonless coating applied to said sheet face within at least a portion of said second panel; and, a quantity of temporary tacking agent applied to said sheet back; folding said sheet into said second folded position such that said quantity of temporary tacking agent releasably holds said sheet back against itself in manner such that said sheet is suitable for printing; and, passing said sheet in said second folded position through a printer.

* * * * *

UNITED STATES PATENT AND TRADEMARK OFFICE

CERTIFICATE OF CORRECTION

PATENT NO. : 6,573,216 B1
DATED : June 3, 2003
INVENTOR(S) : Washburn et al.

It is certified that error appears in the above-identified patent and that said Letters Patent is hereby corrected as shown below:

Column 9,
Line 39, reads as "provide g source" should read -- provide a source --.
Line 47, reads as "coatings 12, 114" should read -- coatings 112, 114 --.

Column 11,
Line 48, reads as "portion on said sheet using a printer; and," should read -- portion back surface by said quantity of temporary tacking agent in a manner suitable for printing on said sheet using a printer; and, --.
Line 52, reads as "according claim" should read -- according to claim --.

Column 12,
Line 37, reads as "claim 27, wherein" should read -- claim 29, wherein --.
Line 41, reads as "A form-according" should read -- A form according --.

Signed and Sealed this

Fourth Day of November, 2003

JAMES E. ROGAN
*Director of the United States Patent and Trademark Office*